United States Patent [19]

Douglas

[11] 3,938,910

[45] Feb. 17, 1976

[54] OIL WELL PUMPOFF CONTROL SYSTEM

[75] Inventor: Bobby L. Douglas, Garland, Tex.

[73] Assignee: Dresser Industries, Inc., Dallas, Tex.

[22] Filed: Nov. 1, 1974

[21] Appl. No.: 519,904

Related U.S. Application Data

[63] Continuation-in-part of Ser. No. 469,264, May 13, 1974, which is a continuation-in-part of Ser. No. 365,881, June 1, 1973, Pat. No. 3,854,846.

[52] U.S. Cl. ..... 417/12; 417/38

[51] Int. Cl.[2] ..... F04B 49/00

[58] Field of Search ..... 417/12, 33, 36, 38, 40, 417/43, 44

[56] References Cited

UNITED STATES PATENTS

| | | | |
|---|---|---|---|
| 2,336,083 | 12/1943 | Franz | 417/33 |
| 3,075,466 | 1/1963 | Agnew et al. | 417/12 |
| 3,091,179 | 5/1963 | Echols | 417/12 |
| 3,453,962 | 7/1969 | Strader | 417/38 |
| 3,610,779 | 10/1971 | Hubby | 417/5 |
| 3,778,694 | 12/1973 | Hubby et al. | 318/474 |
| 3,851,995 | 12/1974 | Mills | 417/12 |

*Primary Examiner*—William L. Freeh
*Assistant Examiner*—G. P. LaPointe
*Attorney, Agent, or Firm*—William E. Johnson, Jr.

[57] ABSTRACT

Various functions of a production oil well are monitored to cause a switch closure for each normal cycle of the pump. Alternatively, the level of the fluid within the well is monitored to cause the switch closure. The switch closure activates a first oscillator whose count is compared with a variable frequency oscillator over a given period of time to ascertain the percentage of time of normal operation. The integrated time is adjusted to shut down the system when the percentage of time drops to or below the preselected amount. In response to the integration timer signal, a shutdown timer is turned on which restarts the cycle after a preselected amount of time. When the system is restarted by the shutdown timer, a pump-up timer is turned on which is adjusted to allow for a desired pump-up time. As the pump-up timer is allowing the system to recycle, the integration timer is reset and the recycling is completed if the requirements of the integration timer are met. Otherwise, the unit is shut down again and the system recycled. A variable electronic scaler is connected to the output of the integration timer which monitors the output signals from the integrator timer. After the preset number of times the integration timer produces a signal, unless reset by a normal cycle, the scaler turns off the whole system. It can then be restarted manually.

21 Claims, 10 Drawing Figures

OIL WELL PUMPOFF CONTROL SYSTEM

RELATED APPLICATION

This application is a continuation-in-part of my U.S. patent application Ser. No. 469,264, filed on May 13, 1974, which in turn is a continuation-in-part of my U.S. patent application Ser. No. 365,881, now U.S. Pat. No. 3,854,846 filed on June 1, 1973, for "Oil Well Pumpoff Control Utilizing Integration Timer".

BACKGROUND OF THE INVENTION

This invention relates to oil wells and more particularly to an automatic well cutoff system for pumping oil wells.

In the production of oil, a well is drilled to the oil bearing strata. At the bottom of the well, a pump is installed to pump oil to the surface of the earth from the pool that gathers at the bottom of the well. A desirable mode of operation is to pump the oil whenever there is sufficient oil in the pool and to stop the pumping when there is not sufficient oil in the pool.

Advantages of this desirable mode of operation are that the pump automatically reaches its optimum pumping rate with a result in a saving of man hours and equipment. The pump thus operates at a greater efficiency in pump displacement, thereby reducing the total number of pumping hours which in itself results in a saving of power and power cost.

Those in the prior art have long recognized the desirability of control systems for providing such an automatic pump-off control of oil wells. Examples of such prior art include U.S. Pat. No. 2,550,093 to G. A. Smith and U.S. Pat. No. 2,316,494 to R. Tipton. In the Smith patent, a valve activates an electrical circuit which causes the pump to be shut down after a predetermined time interval in the event the produced oil ceases to flow through the valve. In the Tipton patent, a clock is caused to run in response to there being no produced fluid, thus causing the pump to periodically cycle in response to the well being pumped dry.

These two patents exemplify the prior art in that various means and systems are provided which monitor the lack of produced fluid and which in turn cause the system to recycle in response thereto.

However, the prior art, to the best of my knowledge, has failed to provide a system which provides satisfactory pumpoff control for the various oil well pumping facilities having varying conditions and components thereof.

A need therefore exists in the oilfield for a means for controlling the operation of oil well pumps in such a manner that the duration of their pumping periods will be substantially or approximately in accordance with the actual time periods required for the pumping off of the wells. Such a need exists for a means of control whereby an oil well can continue in operation so long as it is pumping oil, but which will automatically stop when it has pumped off the oil, or for breakage, in response to cessation of discharge of oil from the pump.

It is therefore the primary object of the present invention to provide a well pumping control system wherein the pump control is a factor of the percentage of time during which oil is being pumped during a given period;

It is also an object of the invention to provide a new and improved well pumping control system wherein the operation of the pump is automatically stopped when the fluid in the borehole is depleted;

It is a further object of the invention to completely shut off the system after a predetermined number of shut-down cycles should proper flow not be reestablished; and Another object of this invention is to provide a system having a variable timing subsystem providing greater flexibility than heretofore known in the prior art.

The objects of the invention are accomplished, generally, by a system which produces signals indicative of the normal operation of the well pumping installation which are used in conjunction with timing circuitry which determines the percentage of time of normal operation during a given time period, and based upon such determination, either allows the system to continue or to shut down. As additional features of the invention, means are provided for the system to recycle and to completely shut down after a predetermined number of nonproductive recycles.

These and other objects, features and advantages of the invention will be more readily understood from the following description taken with reference to the attached drawing, in which.

Figure 3:
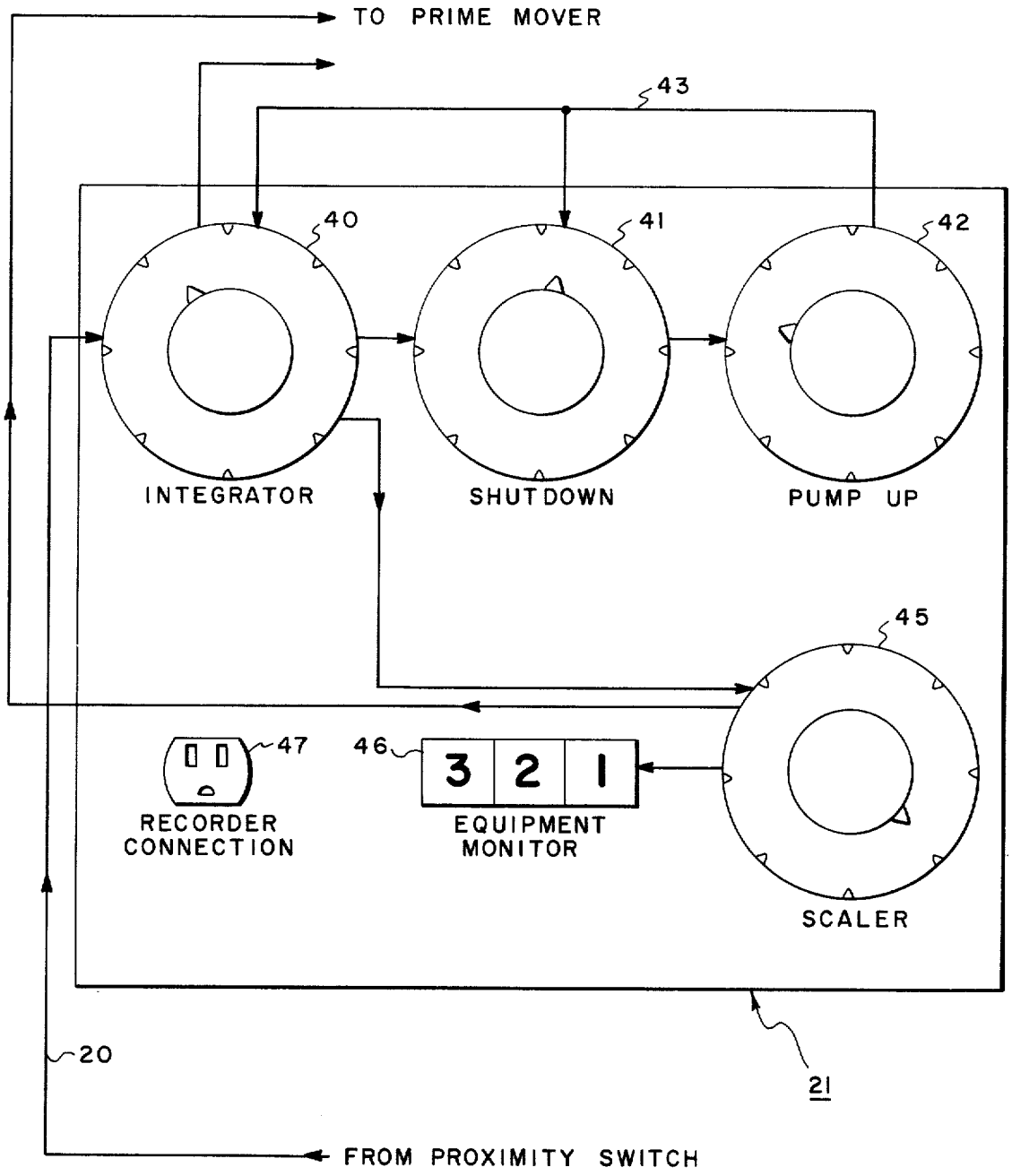
Figure 4:
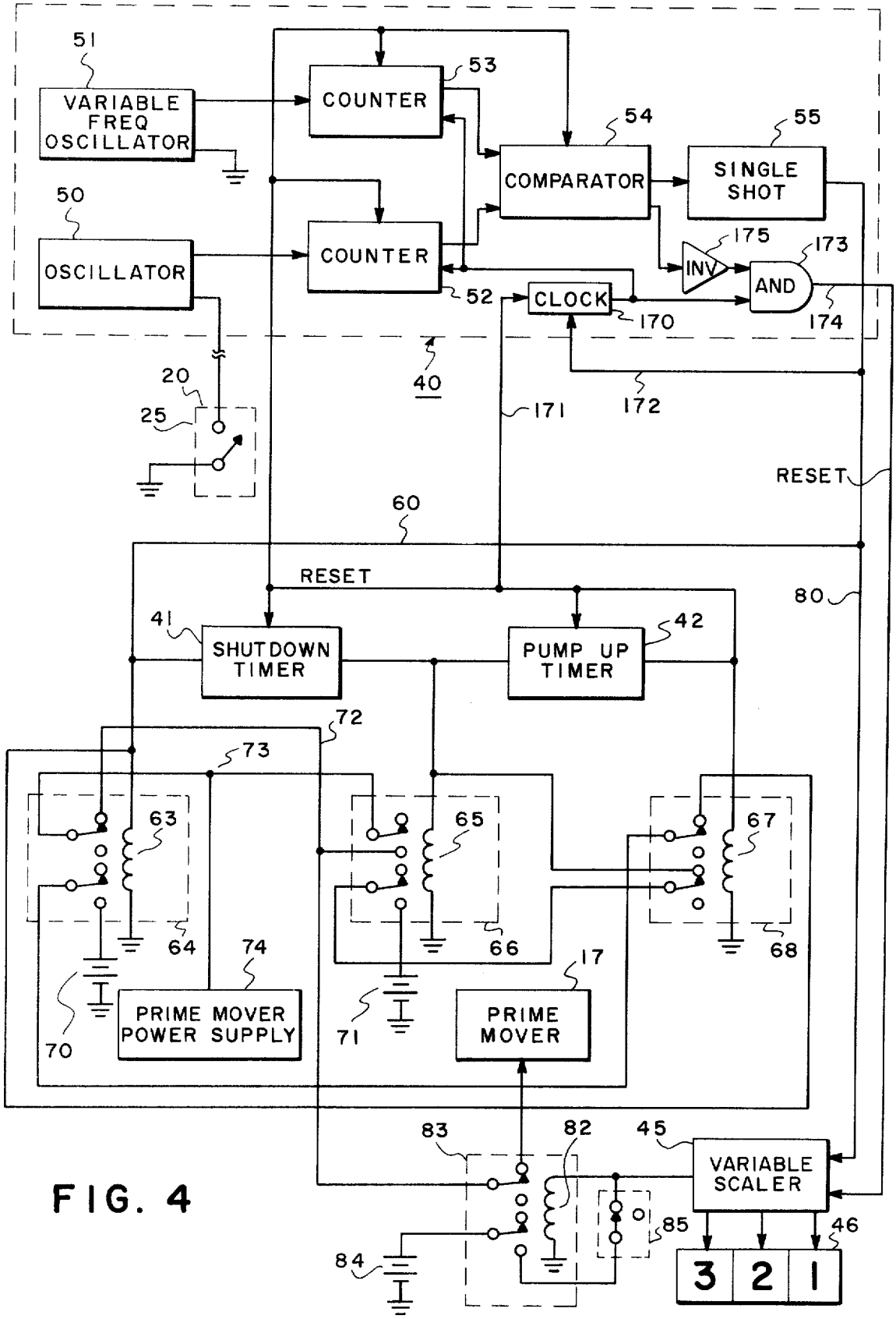
Figure 5:
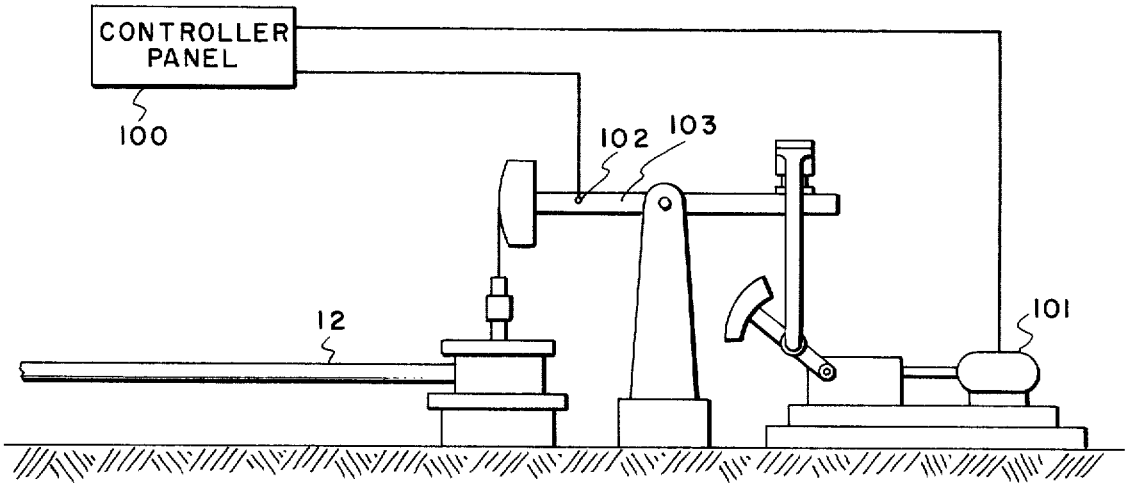
Figure 6:
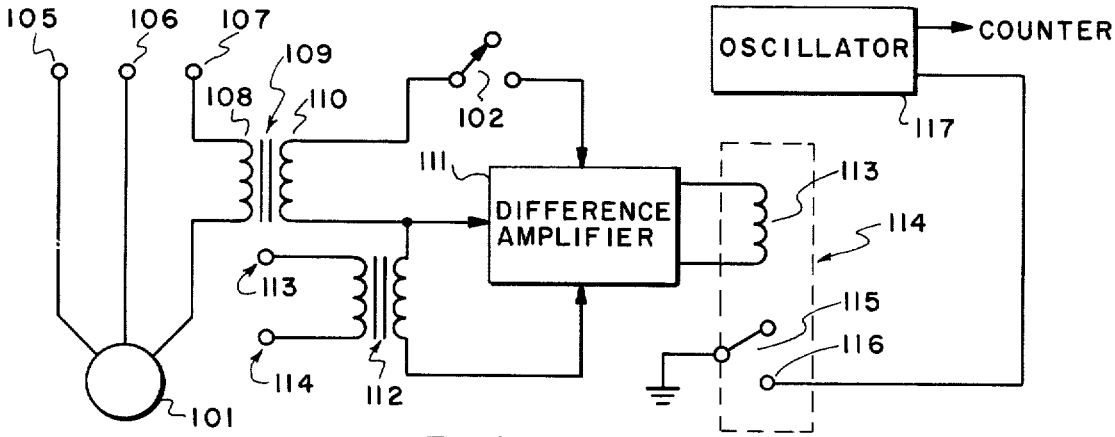
Figure 7:
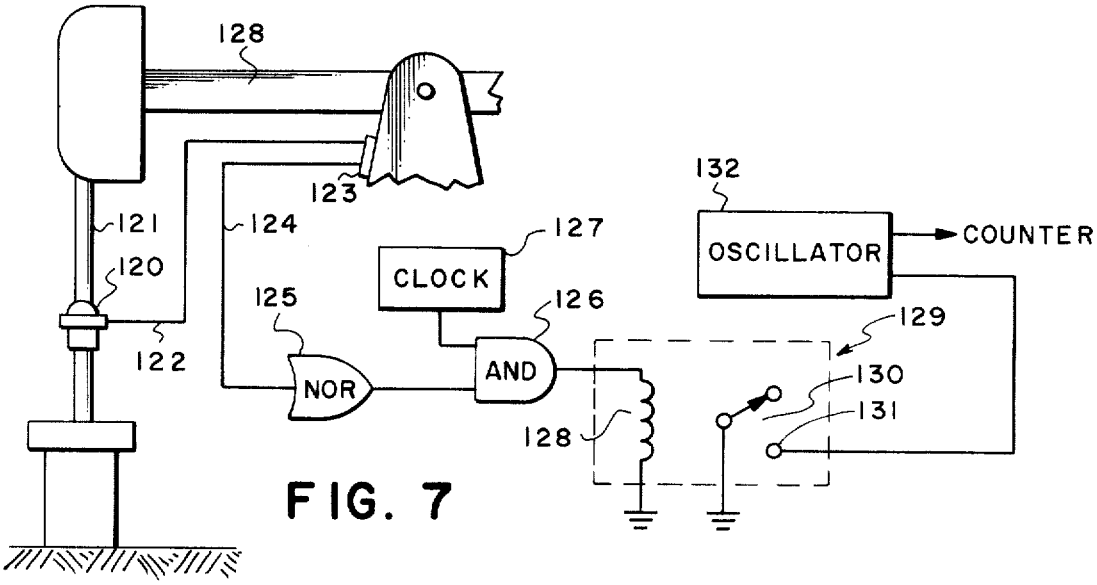
Figure 8:
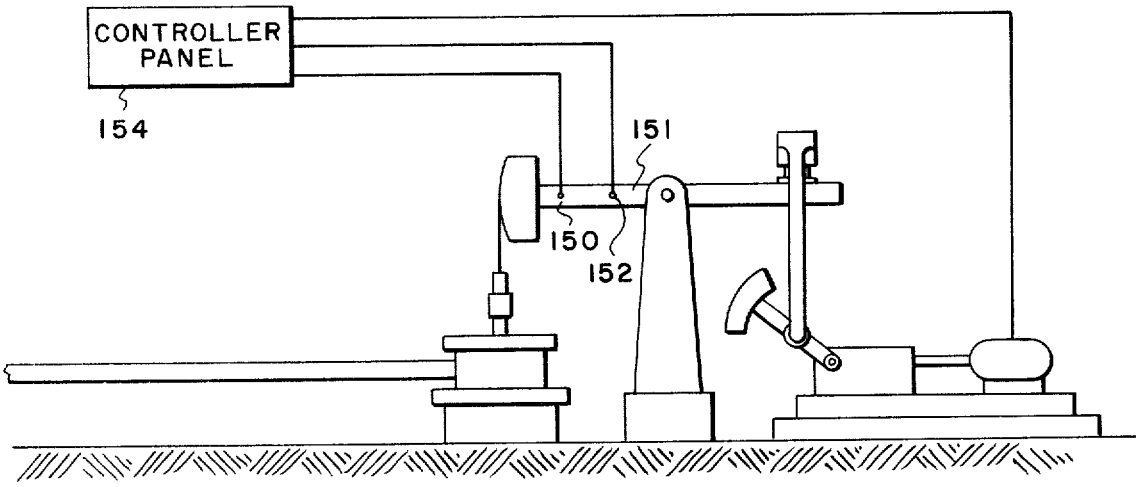
Figure 9:
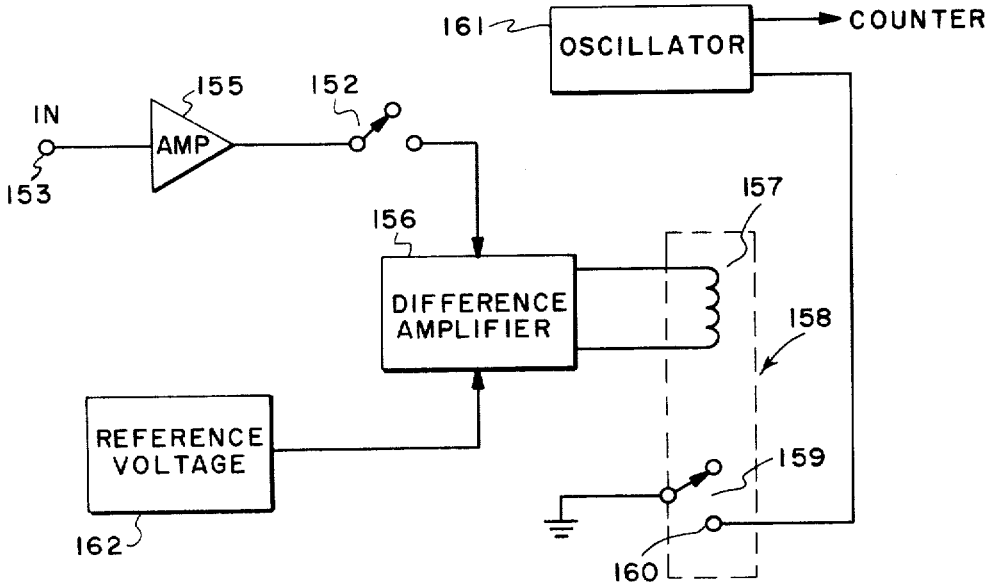
Figure 10:
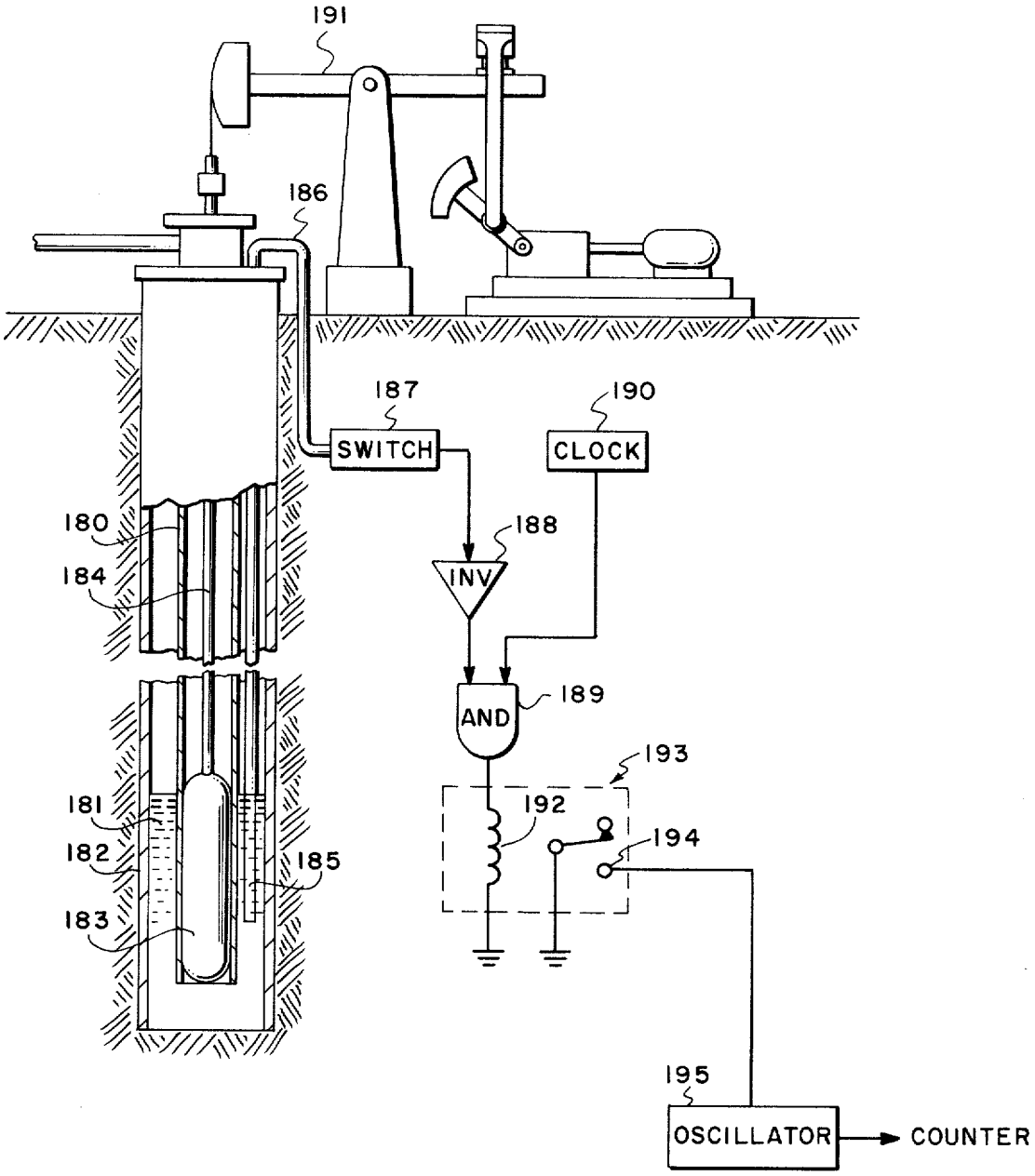

FIG. 3 schematically illustrates the timing system, partly as a flow diagram, according to the present invention;

FIG. 4 schematically illustrates, partly in block diagram, the electrical circuitry of the invention;

FIG. 5 is a diagrammatic sketch illustrating the component parts of an alternative embodiment of the present invention;

FIG. 6 schematically illustrates, partly in block diagram, the electrical circuitry used with the embodiment according to FIG. 5;

FIG. 7 schematically illustrates yet another alternative embodiment of the present invention;

FIG. 8 is a diagrammatic sketch illustrating the component parts of still another alternative embodiment of the present invention;

FIG. 9 schematically illustrates, partly in block diagram, the electrical circuitry used with the embodiment according to FIG. 8; and FIG. 10 illustrates schematically still another alternative embodiment of the present invention.

Figure 1:
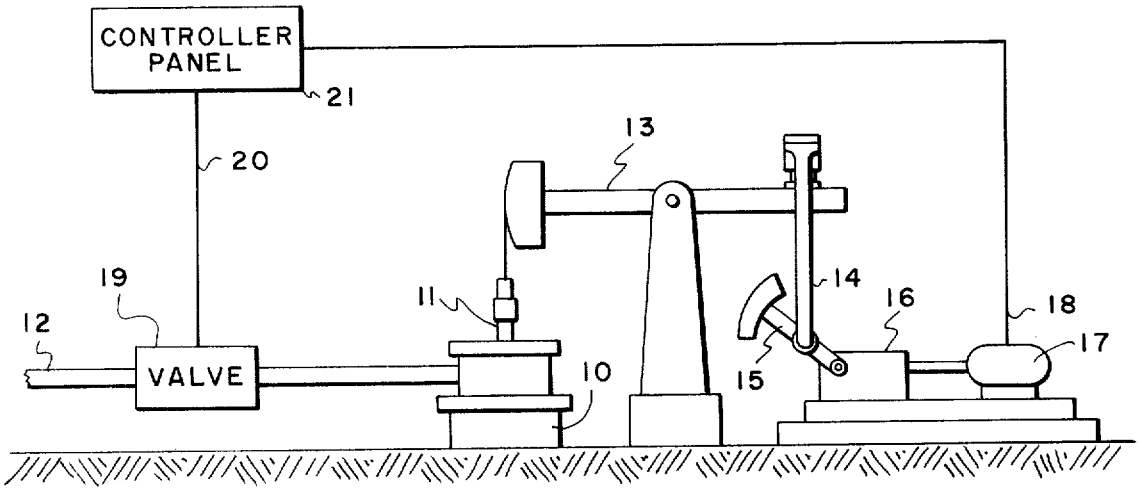
FIG. 1 is a diagrammatic sketch illustrating the component parts of the present invention.

Referring now to the drawing in more detail, especially to FIG. 1, a subsurface pump (not shown) located in well 10 is actuated in a well-known manner by means of a sucker rod string 11, the well fluid lifted to the surface being directed to storage through a pipe 12. The sucker rod string 11 is reciprocated in the well by the offsetting motion of a walking beam 13, which is driven through a pitman 14, crank 15 and speed reducing mechanism 16 by a prime-mover 17 such as an electric motor receiving its power through lead 18. It should be appreciated that any suitable type of motor or engine may be used as the prime mover 17, for example, a gasoline engine having its energizing ignition current supplied through lead 18.

Figure 2:
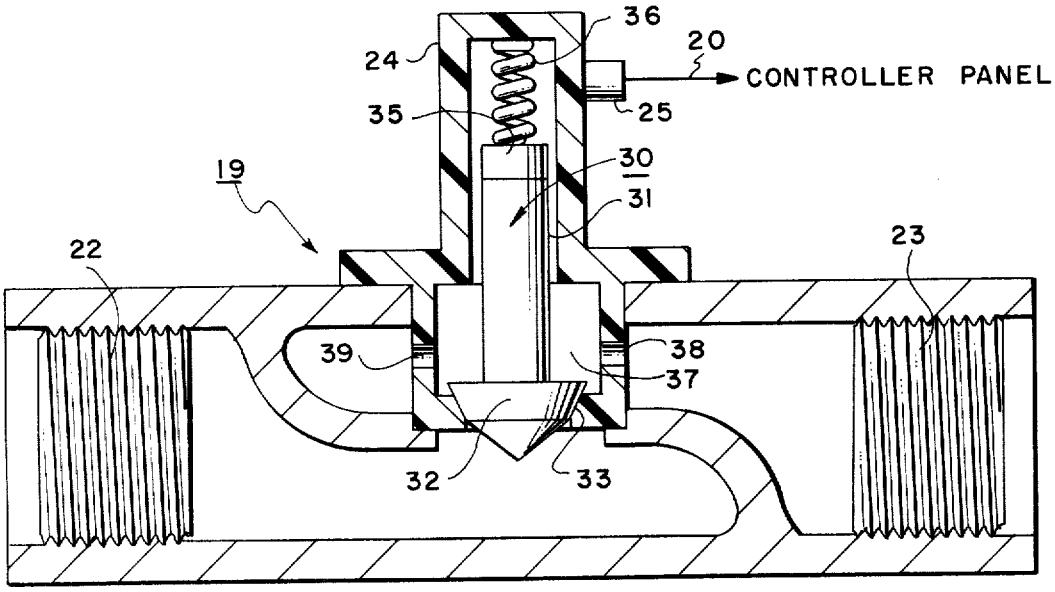
FIG. 2 is a view, partly in cross section, illustrating the valve and sensor means utilized to show produced fluid within the flow line.

A valve assembly 19, shown in more detail in FIG. 2, is located within the pipe 12 and has an electrical conductor 20 leading from the valve assembly 19 to a controller panel 21 shown in more detail in FIG. 3.

Referring now to FIG. 2, the valve assembly 19 is illustrated in greater detail. This valve assembly is substantially cylindrical in shape and has threaded connections 22 and 23 on opposite ends to facilitate assembly within the flow pipe 12 of FIG. 1. A cylindrical valve housing 24 constructed, for example, of plastic and fabricated perpendicularly to the axis between threaded ends 22 and 23, has mounted on its exterior surface a proximity switch 25, for example, a reed switch having an electrical conductor 20 leading therefrom to the controller panel 21.

A valve 30 is located within the valve housing 24 and has an elongated cylindrical body portion 31 and a frusto-conical sealing section 32 at its lower end adapted to engage a frustoconical valve seat 33 in the lower portion of the valve housing 24. Although the valve 30 could be fabricated in various ways, it should be appreciated that it can be constructed in accordance with my co-pending U.S. patent application Ser. No. 301,557, now U.S. Pat. No. 3,861,646 filed on Oct. 22, 1972, for "Dual Sealing Element Valve for Oil Well Pumps and Method of Making Same", assigned to the assignee of the present invention. The full disclosure of said application is incorporated herein by reference.

A magnet 35 is attached to the uppermost section of the valve body 31 and is adapted to close the proximity switch 25 whenever the valve is lifted from the valve seat 33. A nonmagnetic spring 36 is used between the upper end of the housing 24 and the valve 30 to spring load the valve 30 into its seating arrangement with the valve seat 33. It should be appreciated that although the housing 24 is illustrated as being of a plastic material, other than non-magnetic housings can be used, for example, certain series of the stainless steel family.

The lower section of the cylindrical valve housing 24 above the valve seat 33 is enlarged with respect to the upper section of the valve housing 24, thus forming a chamber 37 for movement of the sealing member 32 as it rises from the valve seat 33. The periphery of such enlarged section has two or more openings 38 and 39 to allow fluid to pass therethrough.

In the operation of the system described with respect to FIG.'s 1 and 2, it should be appreciated that as the fluid is pumped from the well 10, it enters the flow pipe 12 and is pumped through the valve assembly 19. In reference especially to FIG. 2, the flow is from the threaded end 22 towards the threaded end 23. Each time the subsurface pump (not shown) causes a surge of fluid, the valve 30 is lifted off the valve seat 33 and the fluid passes out through the ports 38 and 39 and on to the threaded end 23 and out through the flow pipe 12. As the valve 30 is lifted off the valve seat 33, the magnet 35 travels near the proximity switch 25, thereby closing the switch and allowing the conductor 20 to be grounded.

Referring now to FIG. 3, there is illustrated in greater detail the control panel 21. The conductor 20, which is grounded each time the proximity switch 25 of FIG. 2 is closed, is connected into an integration timer 40, the output of the integrator timer 40 being connected to a shutdown timer 41 whose output is connected to a pump-up timer 42. The output of the integrator timer 40 is also connected to the variable electronic scaler 45 whose output drives a visual monitor 46 bearing the legend "EQUIPMENT MONITOR". The output of the pump-up timer 42, through a reset line 43, causes each of the three timers to be reset upon a recycling of the system. It should be appreciated that the illustration of FIG. 3 is included primarily to show the physical layout of the timing mechanisms and the visual monitor 46. As will be explained in more detail with respect to FIG. 4, the visual monitor 46 has any given number of lights but the preferred number is three, bearing the numerals "1", "2" and "3", respectively. As the signals are received sequentially by the scaler 45 from the integrator timer circuit 40, the lights in the monitor 46 are activated in succession to indicate the number of times the system has been shut down. For example, during the operation of the system, the first time the system is shut down, the number "1" will be lighted by a red light on the monitor 46 and the numerals "2" and "3" will be sequentially illuminated on subsequent shutdowns. A recorder connection 47 is provided for utilizing a strip chart recorder or the like in providing a permanent monitor of the operation of the system.

The integration timer 40, shutdown timer 41 and pumpup timer 42 are commercially available from the Eagle Bliss Division of Gulf-Western Industries, Inc. of 925 Lake Street, Baraboos, Wisconsin 53193, such items bearing the following part numbers: integration timer 40, Part No. HP51A6; shutdown timer 41, Part No. HP510A6; and pump-up timer 42, Part No. HP56A6.

Referring now to FIG. 4, the electrical circuitry of the system is illustrated in greater detail. The proximity switch 25 is shown as applying, upon its closure, a ground to the conductor 20. The conductor 20 is connected to one of the outputs of the oscillator 50 within the integrator timer circuit 40. The oscillator 50 can be set at any frequency desired, but as is explained hereafter, is preferably operating at approximately twice the frequency of the variable frequency oscillator 51. By way of further example, the oscillator 50 has a nominal frequency of 10 kHz and the variable frequency oscillator 51 is set at 5 kHz. The outputs of the oscillator 50 and the oscillator 51 are connected to digital counters 52 and 53, respectively. The outputs of the counters 52 and 53 are connected into a comparator circuit 54. If the output of the counter 53 exceeds the output of the counter 52, as shown by the comparator 54, this is indicative that the system is pumping oil less than fifty percent of the time. In response to such an adverse comparison, the comparator 54 generates a signal which in turn triggers the single shot multivibrator circuit 55 which in turn is connected into other of the components of the circuitry of FIG. 4. Although the oscillator 50 has been described as being set at twice the frequency of the oscillator 51, other frequencies can be used to provide different percentages. Thus, if the oscillator 50 is set at four times the frequency of the oscillator 51, then the system ascertains whether the oil is being pumped 25 percent of the time. It should also be appreciated that it is preferable to provide a comparison over a given period of time, for example, during one minute. This eliminates problems such as might be occasioned by an infrequent gas bubble or the like which might cause the valve to not come off the seat 33 upon any given stroke of the pump. Since a percentage of 50 percent is theoretically the perfect condition, a reasonable setting of the variable frequency oscillator would be 4 kHz in conjunction with the 10 kHz output of the oscillator 50. Under these conditions, a signal would not be produced from the single shot multivibrator 55 until there was a showing that the system was operating less than forty percent of the time. For this purpose, a clock 170 having an output connected to counters 52 and 53 is used to supply the given period of time and can be preset for any desirable time period, such as one minute. The clock runs only during the normal pumping period and is started by the single output of the pump-up timer 42 transmitted along conductor 171. The clock is stopped by the shutdown signal from the single shot multivibrator 55 transmitted along conductor 172.

Counters 52 and 53 can be of the type having conventional shift registers which are clocked out into the comparator 54 upon receiving the clock pulse periodically, for example, every minute. Thus, during the time between the termination of the pump-up period and the shutdown signal generated by the single shot 55, the clock will transmit output pulses to the shift registers at the predetermined intervals. By then comparing the outputs of counters 52 and 53, the apparatus determines whether the percentage of time the switch 25 has been closed is at, above, or below the preset value.

The output of clock 170 is also connected to one input of an AND gate 173 which is used in the reset circuit for the scaler 45. A reset line 174 connects the AND gate 173 to the scaler 45. The AND gate receives as a second input the output from an inverter 175. The inverter 175 receives the output signal from comparator 54, inverts the signal and transmits it to the AND gate 173.

The output of the single shot multivibrator 55 is connected by conductor 60 to the input of the shutdown timer 41 which can be adjusted to any predetermined period, for example, four hours. The output of the shutdown timer 41 is connected to the input of a pump-up timer 42 which can also be adjusted to any preselected time, for example, twenty minutes. The shutdown timer 41 and the pump-up timer 42 each contains a single shot multivibrator for producing a single pulse at their respective outputs at the conclusion of the given time periods.

The conductor 60 is also connected to the coil 63 of a relay 64, the other side of the coil 63 being grounded. The relay 64 has a pair of normally open and normally closed contacts. The output of the shutdown timer is also connected to the coil 65 of a relay 66, the other side of the coil 65 being grounded. The relay 66 also has a pair of normally open and normally closed contacts. The output of the pump-up timer 42 is connected to the coil 67 of a relay 68, the other side of the coil 67 being grounded. The relay 68 also has a pair of normally open and normally closed contacts.

The lower normally open contact of relay 64 is connected to a power supply, illustrated as being a battery 70 which is of adequate voltage to maintain the relay 64 in the latched position. The lower normally open contact of relay 66 is similarly connected to a power supply 71 for similar reasons. The upper normally closed contact of relay 64 is connected to a conductor 72 which in turn is connected to the upper normally open contact of relay 66. The upper wiper arm of relay 64 is connected to conductor 73 which is connected directly to the prime-mover power supply 74 output. The conductor 73 is also connected to the upper wiper arm of relay 66. The lower wiper arm of relay 64 is connected to the upper wiper arm of relay 68. The lower wiper arm of relay 66 is connected to the lower wiper arm of relay 68. The ungrounded side of the coil 65 in relay 66 is connected to the lower normally closed contact of relay 68. The upper normally closed contact of relay 68 is connected to the ungrounded side of the coil 63 in relay 64.

The output of the single shot multivibrator 55 is also connected through conductor 80 to the input of a variable electronic scaler 45 which, for example, produces one pulse out for each three pulses in from the single shot multivibrator 55. The output of the scaler 45 is connected to the top of a coil 82 of a relay 83, the other side of the coil 82 being grounded. The upper normally closed contact of relay 83 is connected directly to the prime-mover 17. The upper wiper arm of relay 83 is connected to conductor 72. The lower wiper arm of relay 83 is connected to a power supply 84 suitable for latching the relay 83. The lower normally open contact of relay 83 is connected through a spring-loaded normally closed switch 85 back to the ungrounded side of the coil 82 of relay 83.

In the operation of the circuit of FIG. 4, there has already been described the effect of an adverse comparison being made in the circuit 54 to thus produce a single voltage pulse from the output of the single shot multivibrator 55 which occurs on the conductors 60 and 80. Such a pulse appearing on the input of the shutdown timer 41 causes the timer 41 to count for a predetermined time interval, for example, four hours. Simultaneously with the production of this signal upon conductor 60, the relay 64 is momentarily energized and latched into a position such that the wiper arms are in contact with the normally open contacts, respectively. The action of the power supply 70 causes the relays to be latched in such a position. This removes the prime-mover power supply 74 from the prime-mover 17 and the pumping action terminates. As soon as the preselected time of the shutdown timer 41 has expired, a single pulse is generated at the output of the timer 41 which activates the relay 66. This causes the relay 66 to latch in position such that the wiper arms are in contact with the normally open contacts, respectively. This causes the output of the prime-mover power supply 74 to be connected to the prime-mover 17 and the pumping action is again commenced. Simultaneously with the activation of the relay 66, the output of the timer 41 is coupled into the pump-up timer 42 which is set for a predetermined time, for example, 20 minutes, and thereafter which generates a single pulse of its own which is coupled back to reset the pump-up timer 42, the shutdown timer 41 and the counters 52 and 53 in the integration timer 40. Simultaneously with this resetting operation, the output of the pump-up timer 42 activates the relay 68 which causes the relays 64 and 66 to be unlatched and their wiper arms to be returned to the positions as illustrated in FIG. 4. This allows the output of the prime-mover supply 74 to remain connected to the prime-mover 17 and the system has thus been recycled.

Each time the output of the single shot multivibrator 55 produces a voltage pulse on the conductor 80, the pulse is coupled into the variable scaler 45 which is set, by way of example, to product a single output pulse for each three pulses in. After the system has been shut down three times, unless reset in the interim by a pulse on the reset line 174, three pulses will have been produced by the single shot multivibrator 55 and thus the scaler circuit 45 will produce a single pulse at its output which activates the relay 83 and which is latched in such a position by the power supply 84. This causes the prime-mover power supply 74 to be removed from the prime-mover 17 and the pumping action is terminated.

The system cannot be recycled at this point until the spring-loaded switch 85 is manually activated to the open position to unlatch the relay 83 and thus allow the system to be recycled. Before the occurrence of the predetermined number of unproductive cycles, a logic "0" at the output of comparator 54 causes a logic "1" to be coupled into the AND gate 173 which together with the clock pulse will cause the scaler to be reset.

Referring now to FIG. 5, an alternative embodiment of the invention is illustrated with respect to a well pumping operation similar to that illustrated in FIG. 1. However, instead of using a valve to indicate the amount of fluid flow within the flow line 12, means are provided to monitor the load current of the pump motor (illustrated in more detail in FIG. 6) to provide an indication of the well pumping operation. The circuitry is provided within the controller panel 100 to monitor the load current of the motor 101. A switch 102 is located on the walking beam 103 and is electrically connected into the circuitry within the controller panel which is further illustrated in FIG. 6. The switch 102 is preferably one or more mercury-capsule type switches that are mounted on the walking beam and can be arranged to be opened or closed as desired upon either the up or the down stroke of the walking beam.

Referring now to FIG. 6, which schematically illustrates the circuitry used with the apparatus of FIG. 5, there is shown a motor 101 which has a power supplied thereto by any feasible electric power source that would be connected to a set of input terminals 105, 106 and 107. This power source may supply three-phase AC power, and the primary 108 of a transformer 109 is connected in series with the phase which is connected to the terminal 107. The secondary coil 110 of transformer 109 is connected to a difference amplifier 111 through switch 102 which is controlled by the walking beam 103 (FIG. 5) such that the voltage is applied only at such times as determined by the position of the walking beam. A second transformer 112 supplies a reference voltage from input terminals 113 and 114 to an additional input of the difference amplifier 111. It should be appreciated that the difference amplifier 111 is conventional and is preferably arranged to supply an output voltage at such times as the voltage applied to transformer 109 exceeds the voltage applied through transformer 112 to the difference amplifier. It should also be appreciated that even though the switch 102 can be activated to close upon either the down stroke or the up stroke of the walking beam 103, the preferred embodiment contemplates that the switch is closed on the up stroke to indicate that the fluid, for example, oil, is being lifted by the pump. As is well known in the art, the motor 101 draws more current when oil is being lifted than when pumping dry. In such a case, the difference amplifier produces an output signal which is applied to the coil 113 of relay 114. The wiper arm 115 of the relay 114 is grounded, and the normally open contact 116 is connected to the oscillator 117. The output of the oscillator 117, which operates in the same manner as the oscillator 50 of FIG. 4, is connected into a counter comparable to the counter 52 of FIG. 4.

In the operation of the circuitry of FIG. 6, as the switch 102 closes on the up stroke of the walking beam 103, the primary coil 108 draws current through the motor 101 and this signal is applied to the difference amplifier 111 in an amount such as to be greater than the signal applied through transformer 112 and a voltage is thus applied to the coil 113 of relay 114. This causes the ground to be applied to the contact 116 and the oscillator 117 thus causes pulses to be coupled into an appropriate counter. Thereafter, the circuitry operates in a similar fashion as that illustrated with respect to FIG. 4 and comparisons are made with another variable frequency oscillator and its associated counter to determine whether the system is operating in a normal fashion for a predetermined percentage of time during a given time period. Assuming that the system is not operating for the predetermined percentage of time in a normal fashion, then the system proceeds to shut down and be recycled as previously discussed with respect to FIG. 4.

Referring now to FIG. 7, there is illustrated an alternative embodiment of the present invention wherein a pumping apparatus similar to that illustrated in FIG. 5 is illustrated but which uses a hydraulic load indicator 120 manufactured, for example, by the J. M. Huber Corporation and which is installed within the sucker rod string 121. This type of indicator produces a hydraulic pressure signal of 100 pounds per square inch for each 1000 pounds of rod weight. Such pressure is carried by the hydraulic line 122 to a hydraulically-operated pressure switch 123, for which the pressure mechanism of the switch is adjustable. In a typical example, the pressure switch is set at 800 pounds per square inch as a threshold pressure so that the pressure switch 123 sends an electrical signal at its output leads which can be used whenever the pressure exceeds 800 pounds per square inch. The electrical signal is coupled by means of conductor 124 to the input of a NOR gate 125 whose output is coupled into one input of AND gate 126. The other input to AND gate 126 is coupled to the output of a clock 127 which produces electrical signals on each down stroke of the walking beam 128. The output of the AND gate 126 is coupled to a coil 128 of relay 129. The wiper arm 130 of relay 129 is grounded, and the normally open contact 131 associated therewith is coupled into the oscillator 132 in a similar manner as is illustrated in FIG. 4 and the output of the oscillator 132 is coupled into an appropriate counter, for example, as illustrated in FIG. 4 with respect to the counter 52.

It is well known in the art, for example, in U.S. Pat. No. 3,306,210 to Harvey W. Boyd et al., that during the down stroke of the pump, the absence of fluid in the borehole causes the hydraulic load indicator 120 to have an excess of weight on the sucker rod string and the switch 123 causes an electrical signal to be coupled into the NOR gate 125. A "1" applied to the input of NOR gate 125 causes a "0" to be coupled into the input of the AND gate 126 which causes a "0" to be applied to the coil 128 and the relay 129 is thus not activated. In such an instance, the ground is not applied to the oscillator 132 and thus no pulses are coupled into the counter. In the normal operation of the pumping sequence, a "0" is applied to the input of the NOR gate 125 and a "1" is thus coupled into the AND gate 126 along with a signal from the clock 127. This produces a " 1" on the coil 128 and the ground is applied to the input of the oscillator 132 which causes pulses to be coupled into the counter as indicative of a normal pumping sequence.

It should be appreciated that even though the preferred embodiment contemplates the use of a clock 127 to generate pulses indicative of the downward movement of the walking beam 128, a switch could also be used as is illustrated with respect to FIG.'s 5 and 6 to couple a voltage source into the AND gate 126.

As previously explained with respect to FIG.'s 4, 5 and 6, the apparatus and circuitry according to FIG. 7 operates in a very similar manner in that the normal pumping sequence causes the relay 129 to be activated for each pumping stroke in which oil is being produced and that pulses will be coupled into a counter similar to counter 52 of FIG. 4 and that the remainder of the circuitry of the counting box 40 can be used to determine whether the pump is pumping fluid for at least a predetermined percentage of time during a given time interval.

Referring now to FIG. 8, there is illustrated an alternative embodiment of the present invention wherein a strain gauge 150 is attached to the walking beam 151 in a manner well knwn in the art to determine whether the walking beam 151 is experiencing a normal amount of stress which follows from the normal pumping sequence of pumping fluid, for example, oil, from a producing oil well. A switch 152, for example, as illustrated and discussed with respect to switch 102 of FIG. 6, is utilized for measuring the stress on either the up or down stroke of the walking beam 151 as desired. The output of the strain gauge 150 is connected to an input terminal 153 within the controller panel 154 and is amplified by an amplifier 155 and coupled through switch 152 into a difference amplifier 156. A reference voltage 162 is coupled into another input of the difference amplifier 156. The output of the difference amplifier 156 is connected to a coil 157 of relay 158 which has its wiper arm 159 grounded. The normally open contact 160 associated therewith is connected to the oscillator 161 which has its output connected into a counter such as counter 52 of FIG. 4.

In the operation of the apparatus and circuitry illustrated in FIG.'s 8 and 9, the electrical signal as measured by the strain gauge 150 is compared with the reference voltage 162 on the up stroke of each cycle of the walking beam 151 which causes switch 152 to close. For each such cycle that the stress exceeds a given level, the relay 158 is activated and the ground is applied to the oscillator 161. With each cycle of the pump that the stress is less than normal, the difference amplifier provides no output and thus no ground will be applied to the oscillator 161. For each normal cycle of the pump, i.e., one in which oil is being pumped, the oscillator 161 is grounded and pulses are connected into a counter and the sequence thereafter of the circuitry functions as is discussed above with respect to FIG. 4.

Referring now to FIG. 10, there is schematically illustrated a well pumping installation having a conventional pumping apparatus at the earth's surface, for example, as illustrated with respect to the apparatus of FIG. 5, and having tubing 180 passing from the earth's surface to the location of the fluid 181 within the well and which is to be pumped to the earth's surface. Casing 182 is maintained between the earth formation and the interior of the well. A conventional pump 183 is connected to the sucker rod 184 and is arranged in a manner well known in the art to pump the fluid 181 to the earth's surface through the tubing 180. A small tube 185 is lowered into the well alongside the tubing 180 and has therein a differential pressure gauge or other such conventional device therein for transmitting a signal to the earth's surface indicative of the liquid level within the well being beneath the sensor or other detector located within the tubing 185. The tubing 185 is connected by conduit 186 at the earth's surface to a switch 187 which generates an electrical signal at its output in response to the sensor within tube 185 being above the level of the fluid in the well. The electrical output of switch 187 is connected into the input of an inverter 188 whose output is connected into one input of AND gate 189. The other input to the AND gate 189 is connected to the output of a clock 190 which generates electrical pulses in coincidence with the movement of the walking beam 191 associated with the pumping apparatus. The output of AND gate 189 is connected to the coil 192 of relay 193. The other side of coil 192 is grounded and the wiper arm of relay 193 is also grounded. The normally open contact 194 of relay 193 is connected to oscillator 195 in a manner similar to the other embodiments illustrated herein, for example, as is illustrated and described with respect to FIG. 6.

In the operation of the apparatus and circuitry which is schematically illustrated with respect to FIG. 10, during the normal pumping sequence the sensor located in tube 185 is located beneath the fluid level 181 within the well and no signal is generated by the switch 187. Thus, a logic "0" is applied to the input of the inverter 188 and a logic "1" is applied to the input of the AND gate 189 as is the output of the clock 190. Thus, as the pump operates, a signal is produced at the output of AND gate 189 each time the pump cycles while the oil or other fluid within the well is above a predetermined level. This causes the relay 193 to be activated which causes the ground to be applied to the oscillator 195 and the circuit thereafter operates in a manner as described with respect to FIG. 4. Thus, this circuitry makes a determination as to whether the oil within the well bore is at or above a predetermined level for more than a given percentage of time during a given time interval.

It should be appreciated that other means are well known in the art for determining the level of the fluid 181 within the well, for example, by acoustic sounding wherein acoustic waves are transmitted from the earth's surface to the surface of the fluid and the returning acoustic waves are measured for time of travel from the earth's surface to the fluid interface to determine the depth of the fluid within the well. Thus, in a manner analogous to that described with respect to the apparatus of FIG. 10, such acoustic sounding methods can be used to indicate that the fluid level is at a certain level for at least a given percentage of time during a predetermined time interval.

Thus it should be appreciated that there have been described and illustrated herein the preferred embodiments of the present invention wherein a vastly new and improved system has been provided for making a determination as to the percentage of time in which fluid is being produced from an oil well, and to control the pumping operation based upon such determination. Those skilled in the art will recognize that modifications can be made to those embodiments as illustrated and described. For example, other types of valves and sensing mechanisms can be used to create an event indicative of the normal sequence of pumping fluid. By way of specific example, the use of a float valve well known in the art can be used to generate an electrical signal or some other such event and such use is contemplated by the invention hereof. Such an event can then be used to aid in the determination of the percentage of time in which the oil is flowing through the flow line. Likewise, while the preferred embodiment contemplates the use of various electrical, mechanical and electro-mechanical timing mechanisms, as well as the use of solid state devices such as the scaler circuit 45, those skilled in the art will recognize that equivalent devices can be used to provide the results of the invention. For example, the entire circuitry of FIG. 4 can be fabricated from solid state components to provide greater space saving and cost reduction, as well as vastly improved reliability. Furthermore, although the preferred embodiment of the invention contemplates the use of electrical signals in determining the percentage of time in which the oil is being pumped, those skilled in the art will recognize that pneumatic signals can also be used in making such a determination. Likewise, although not illustrated, a ramp voltage device can be used and its amplitude compared at a given time with a known amplitude to provide a determination of the percentage of time during which the oil is being pumped.

The embodiments of the invention in which an exclusive property or privilege is claimed are defined as follows:

1. A system for controlling the operation of a well pumping installation including a pump, a motor for operating said pump, a sucker rod string, a walking beam and a pumped fluid flowpipe, comprising:

means responsive to a predetermined characteristic of a component of said well pumping installation;

means to generate signals indicative of said response;

means to determine whether said signals are occurring less than a predetermined percentage of time during a given time interval; and means to terminate the pumping operation in the event of said lesser determination.

2. The system according to claim 1, including in addition thereto, means for recycling the operation after a predetermined time following the termination of the operation.

3. The system according to claim 2, including in addition thereto, means for preventing recycling of the operation after such operation has been recycled a predetermined number of times.

4. The system according to claim 1 wherein said means responsive to a predetermined characteristic of a component of said well pumping installation comprises circuitry for monitoring the load current of said motor and for comparing the level of said load current with a predetermined reference level.

5. The system according to claim 1 wherein said means responsive to a predetermined characteristic of a component of said well pumping installation comprises means for monitoring the weight imposed on said sucker rod string during selected portions of the pumping cycle and for making determinations as to the level of said weight with respect to a given reference level.

6. The system according to claim 1 wherein said means responsive to a predetermined characteristic of a component of said well pumping installation comprises means for measuring the stress imparted to said walking beam during selected portions of the pumping cycle and for making determinations as to the level of said stress with respect to a given reference level.

7. In an oil well production control system having pumping means, means for monitoring well production, means for shutting down the pumping means in response to the production dropping below a predetermined level, said means for automatically restarting the pumping means after a period of time, the improvement comprising:

means for limiting the number of said automatic restarting cycles to a predetermined number of times.

8. In an oil well production control system having pumping means, means for monitoring well production, means for shutting down the pumping means in response to the production dropping below a predetermined level, and means for automatically restarting the pumping means after a period of time, the improvement comprising:

means for limiting the number of said automatic restarting cycles to a predetermined number of times; and means to reset said limiting means in response to said production rising to at least said predetermined level prior to said predetermined number being reached.

9. A production control system for controlling an oil well pumping apparatus, comprising:

means for monitoring well production;

means for shutting down the pumping apparatus in response to the production dropping below a predetermined level;

means for automatically restarting the pumping apparatus after each shutdown; and means for limiting the number of said automatic restarts to a predetermined number.

10. A production control system for controlling an oil well pumping apparatus having a pumped fluid flowpipe, comprising:

means for monitoring the flow of oil through said pumped fluid flowpipe;

means for shutting down said pumping apparatus in response to said monitored flow dropping below a predetermined level;

means for automatically restarting the pumping apparatus after each shutdown; and means for limiting the number of said automatic restarts to a predetermined number.

11. A production control system for controlling an oil well pumping apparatus having a pump drawing electrical current, comprising:

means for monitoring said electrical current during selected portions of the pumping cycles;

means for shutting down said pumping apparatus in response to said monitored electrical current having an adverse comparison with a reference signal;

means for automatically restarting the pumping apparatus after each shutdown; and means for limiting the number of said automatic restarts to a predetermined number.

12. A production control system for controlling an oil well pumping apparatus having a sucker rod string, comprising:

means for monitoring the weight exerted on said sucker rod string during selected portions of the pumping cycles;

means for shutting down said pumping apparatus in response to said weight having an adverse comparison with a reference signal;

means for automatically restarting the pumping apparatus after each shutdown; and means for limiting the number of said automatic restarts to a predetermined number.

13. A production control system for controlling an oil well pumping apparatus having a walking beam, comprising:

means for monitoring the stress on said walking beam during selected portions of the pumping cycles;

means for shutting down said pumping apparatus in response to said stress having an adverse comparison with a reference signal;

means for automatically restarting the pumping apparatus after each shutdown; and means for limiting the number of said automatic restarts to a predetermined number.

14. A system for controlling the operation of a well pumping installation including a pump, a motor for operating said pump, a sucker rod string, a walking beam and a pumped fluid flowpipe, comprising:

means responsive to a predetermined characteristic of a component of said well pumping installation;

means to generate signals indicative of said response;

means to determine whether said signals are occurring less than a predetermined percentage of time during a given time interval;

means to terminate the pumping operation in the event of said lesser determination;

means for recycling the operation after a predetermined time following the termination of the operation; and means for preventing recycling of the operation after such operation has been unsuccessfully recycled a predetermined number of times.

15. The system according to claim 14 wherein said means responsive to a predetermined characteristic of a component of said well pumping installation comprises circuitry for monitoring the load current of said motor and for comparing the level of said load current with a predetermined reference level.

16. The system according to claim 14 wherein said means responsive to a predetermined characteristic of a component of said well pumping installation comprises means for monitoring the weight imposed on said sucker rod string during selected portions of the pumping cycle and for making determinations as to the level of said weight with respect to a given reference level.

17. The system according to claim 14 wherein said means responsive to a predetermined characteristic of a component of said well pumping installation comprises means for measuring the stress imparted to said walking beam during selected portions of the pumping cycle and for making determinations as to the level of said stress with respect to a given reference level.

18. In an oil well production control system having pumping means, means for monitoring the level of fluid in the well, means for shutting down the pumping means in response to the fluid level dropping below a predetermined level, and means for automatically restarting the pumping means after a period of time, the improvement comprising:

means for limiting the number of said automatic restarting cycles to a predetermined number of times.

19. In an oil well production control system having pumping means, means for monitoring the level of fluid in the well, means for shutting down the pumping means in response to the fluid level dropping below a predetermined level, and means for automatically restarting the pumping means after a period of time, the improvement comprising:

means for limiting the number of said automatic restarting cycles to a predetermined number of times; and means to reset said limiting means in response to said fluid level rising to at least said predetermined level prior to said predetermined number being reached.

20. A production control system for controlling an oil well pumping apparatus, comprising:

means for monitoring the level of fluid in a well;

means for shutting down the pumping apparatus in response to the fluid level dropping below a predetermined level;

means for automatically restarting the pumping apparatus after each shutdown; and means for limiting the number of said automatic restarts to a predetermined number.

21. A production control system for controlling an oil well pumping apparatus, comprising:

means for monitoring the level of fluid in a well;

means for shutting down the pumping apparatus in response to the fluid level dropping below a predetermined level;

means for automatically restarting the pumping apparatus after each shutdown;

means for limiting the number of said automatic restarts to a predetermined number; and means to reset said limiting means in response to said fluid level rising to at least said predetermined level prior to said predetermined number being reached.

* * * * *

UNITED STATES PATENT OFFICE

CERTIFICATE OF CORRECTION

PATENT NO. : 3,938,910

DATED : February 17, 1976

INVENTOR(S) : Bobby L. Douglas

It is certified that error appears in the above-identified patent and that said Letters Patent are hereby corrected as shown below:

In the Abstract, line 8, change "time" to "timer".

Column 3, line 34, omit the word "than".

Column 6, line 59, change "product" to "produce".

Column 9, line 16, change "knwn" to "known".

Column 10, line 58, change "those" to "these".

Column 11, line 68, change "said" to "and".

Signed and Sealed this

*twenty-seventh* Day of *April 1976*

[SEAL]

*Attest:*

RUTH C. MASON
*Attesting Officer*

C. MARSHALL DANN
*Commissioner of Patents and Trademarks*